United States Patent [19]

Moriez et al.

[11] 4,206,577

[45] Jun. 10, 1980

[54] REFRACTORY LINING ELEMENT FOR A FURNACE OR THE LIKE

[75] Inventors: Marcel Moriez, Palaiseau; Jacques Delobel, Paris, both of France; Societe Europeene Des Products Refractories, 02, Neuilly sur Seine, France

[73] Assignee: Societe Europeene des Produits Refractories, Neuilly sur Seine, France

[21] Appl. No.: 912,326

[22] Filed: Jun. 5, 1978

[30] Foreign Application Priority Data

Jun. 17, 1977 [FR] France ..... 77 18679

[51] Int. Cl.[2] ..... E04B 2/00

[52] U.S. Cl. ..... 52/405; 52/593; 52/596; 52/506

[58] Field of Search ..... 52/405, 596, 513, 593, 52/606, 434, 435, 439, 589, 506, 579; 110/336, 338

[56] References Cited

U.S. PATENT DOCUMENTS

| | | | |
|---|---|---|---|
| 360,625 | 4/1887 | Snell | 52/573 |
| 1,542,909 | 6/1925 | Regan | 52/439 X |
| 1,807,138 | 5/1931 | Spelshouse | 52/606 |
| 2,736,188 | 2/1956 | Wilhelm | 52/606 X |
| 3,158,963 | 12/1964 | Demaison | 52/405 X |
| 3,380,409 | 4/1968 | Olsen | 110/336 |
| 4,134,241 | 1/1979 | Walton | 52/405 X |

*Primary Examiner*—Price C. Faw, Jr.
*Assistant Examiner*—Carl D. Friedman
*Attorney, Agent, or Firm*—Frost & Jacobs

[57] ABSTRACT

The element includes lateral walls and a bottom. An inner gap is arranged to be filled with bulk fiber. The walls and the bottom are formed of fibers bonded together. The bottom has a projection arranged to be nested in the inner space of an adjacent element.

5 Claims, 6 Drawing Figures

REFRACTORY LINING ELEMENT FOR A FURNACE OR THE LIKE

BACKGROUND OF THE INVENTION

1. Field of the Invention

The present invention relates to a refractory lining element for a furnace or the like, formed essentially from refractory fibers.

2. Description of the Prior Art

The linings of furnaces or similar enclosures kept at high temperature are generally constituted by refractory bricks obtained either by baking, sintering or fusion of refractory materials whose choice depends on the conditions of operation. Fireclay linings and refractory concretes are also known.

Lining elements also currently used are constituted from refractory fibers, which take advantage of the superior properties of these materials with regard to thermal insulation and lightness.

Customarily, these elements each comprise two principal walls, generally flat or with a large radius of curvature, of which one is designed to constitute the inner wall of the furnace and the other the outer wall of the lining, turned towards the metallic wall of the furnace. Small lateral walls connect the two principal walls holding them to a predetermined separation and are designed to cooperate with those of neighboring similar elements to form the lining. Two other sides are empty, so that the element appears as a tube with an elongated rectangular cross-section.

The inner gap is filled with mineral fiber after the positioning of a certain number of lining elements by stuffing from one end of one of the channels constituted by the inner gaps of the element.

It has been proposed, in U.S. Pat. No. 3,158,963, to use lining elements of non-fibrous, light refractory material, with filling of the gaps by lighter refractory material, and the technique which has been described is only the adaptation of this patent to the use of fibrous materials.

However, this adaptation has some drawbacks: the placing in position of fibers by stuffing is not always easy and does not permit complete homogeneity to be guaranteed since, with time, the fibers have a tendency to become packed in the bottom of the channel and gaps can appear towards the top, which creates a heterogeneity prejudicial to the whole.

The aforementioned U.S. Pat. No. 3,158,963 provides, it is true, for the lateral walls of the elements to be modifiable to ensure communication between the inner gaps of adjacent elements in the horizontal direction, which is of a nature to create a certain number of anchoring points for the fiber filling, but this solution does not contribute complete security and risks the creation of irregularities in the filling.

It has also been proposed, in U.S. Pat. No. 2,534,973, to constitute the filling by a stack of elements including a gap which is open in the direction of the inside of the furnace and which is closed on the other side, this gap being filled with refractory fibers, if necessary before the placing in position of the element. In this way the abovedescribed drawbacks are avoided, but the fibers are directly exposed to the atmosphere and to the substances which are in the furnace, which is of a nature to considerably reduce their longevity, even when precautions are taken to prevent them from falling inside the furnace, and it is provided for these fibers to be agglomerated together by a binder such as a cement, which reduces their insulating power.

On the other hand, the simple juxtaposition of each of the elements such as is generally practiced does not offer a sufficient guarantee of sealing in service.

It is an object of the present invention to provide an improved lining element of the aforementioned type which overcomes the abovementioned drawbacks of the prior art.

It is another object of the invention to provide an improved method of constructing a furnace lining which overcomes the abovementioned drawbacks.

Other objects and advantages will appear from the description which follows.

GENERAL DESCRIPTION OF THE INVENTION

According to the present invention there is provided a lining element of the aforementioned type, of novel form, for walls and ceilings, in which the inner fiber stuffing is already effected before positioning, and of which the original mode of juxtaposition is constituted on the one hand by nesting and on the other hand by the interposition of a beading, to ensure homogeneity and fluid-tightness in service.

According to an advantageous feature of the invention a simple method of fixing by a binding iron enables additionally the ensuring of mechanical stability of the whole of the lining constructed from such an element, both in the walls and in the ceilings.

BRIEF DESCRIPTION OF THE DRAWINGS

The invention will be explained in more detail with reference to the accompanying drawings in which.

DESCRIPTION OF A PREFERRED EMBODIMENT

Figure 2:
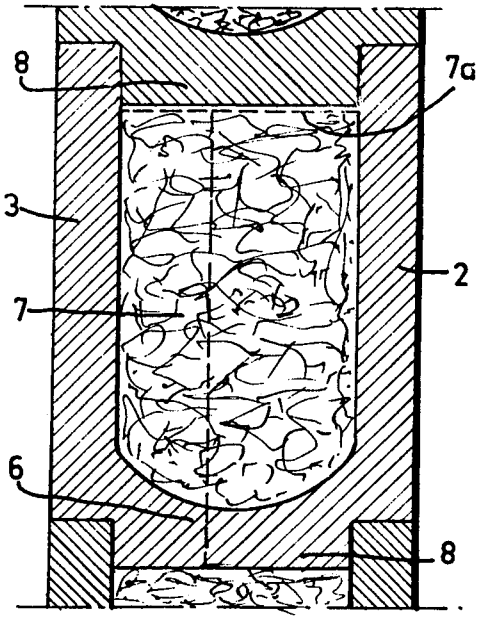
FIGS. 1, 2 and 3 show longitudinal, transverse and horizontal sections of a refractory lining element according to the invention, given purely by way of non-limiting example.

As shown in FIGS. 1 to 4, a lining element 1 comprises two large walls 2, 3 arranged to form the inner and outer walls of the lining, two small walls 4, 5 and a bottom 6. The central part of the element is occupied by a cavity 7 filled with bulk fiber maintained in position by a holding element *7a;* this element can be of a material which disappears on heating, by combustion or volatilization, or of a heat-resistant material, such as glass fiber. It is preferably constituted by a grid, with fairly large mesh of at least 2 mm and preferably more than 4 mm. The bottom 6 of the element comprises a central projecting part 8 which, to close tolerances, has a width equal to that of the cavity 7 and hence becomes fitted into the upper part of the cavity 7 of one or several identical elements placed below.

The small sides 4, 5 have, at their upper part, a channeling 9, 10 of equal width and depth, within close tolerances, to the width and height of the projection 8 of the bottom, which permits the positioning of the superposed elements in alternate lines, each of them occuring above two elements of the lower line.

Figure 3:
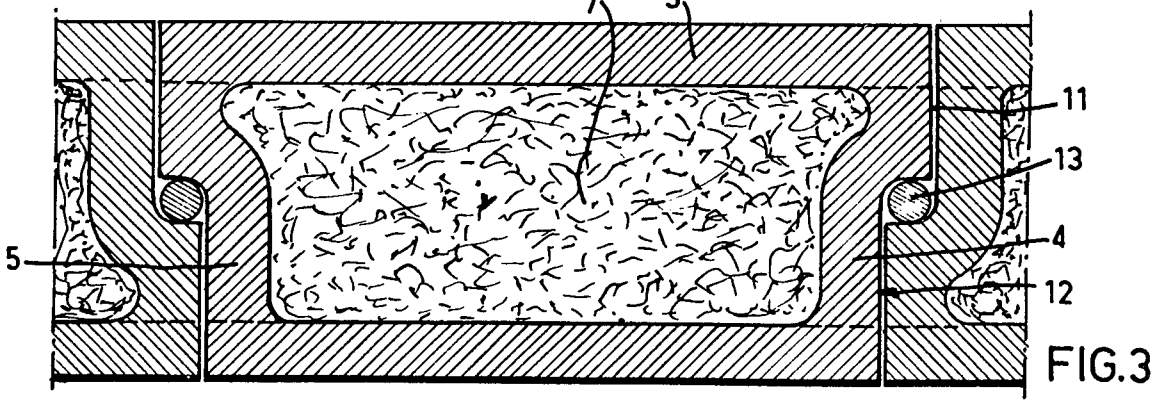
Figure 1:
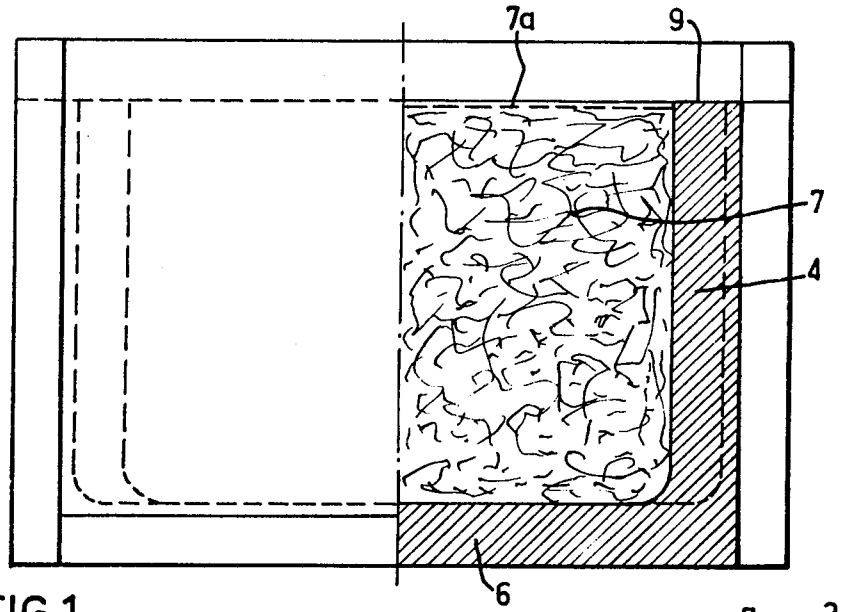

In addition the small sides 4, 5 have an outer surface constituted by two offset vertical planes 11, 12 connected through a vertical rounded surface. In FIG. 3 it is to be seen that the juxtaposition of two elements forms a cavity adapted to receive the sealing beading 13. This beading also constituted by refractory fibers is of cylindrical or rectangular section.

Beadings suitable for this use are described in French Pat. No. 1,465,670.

The dimensions of the bead are selected so as to create, on mounting, a compression of the latter to ensure effective sealing.

Figure 4:
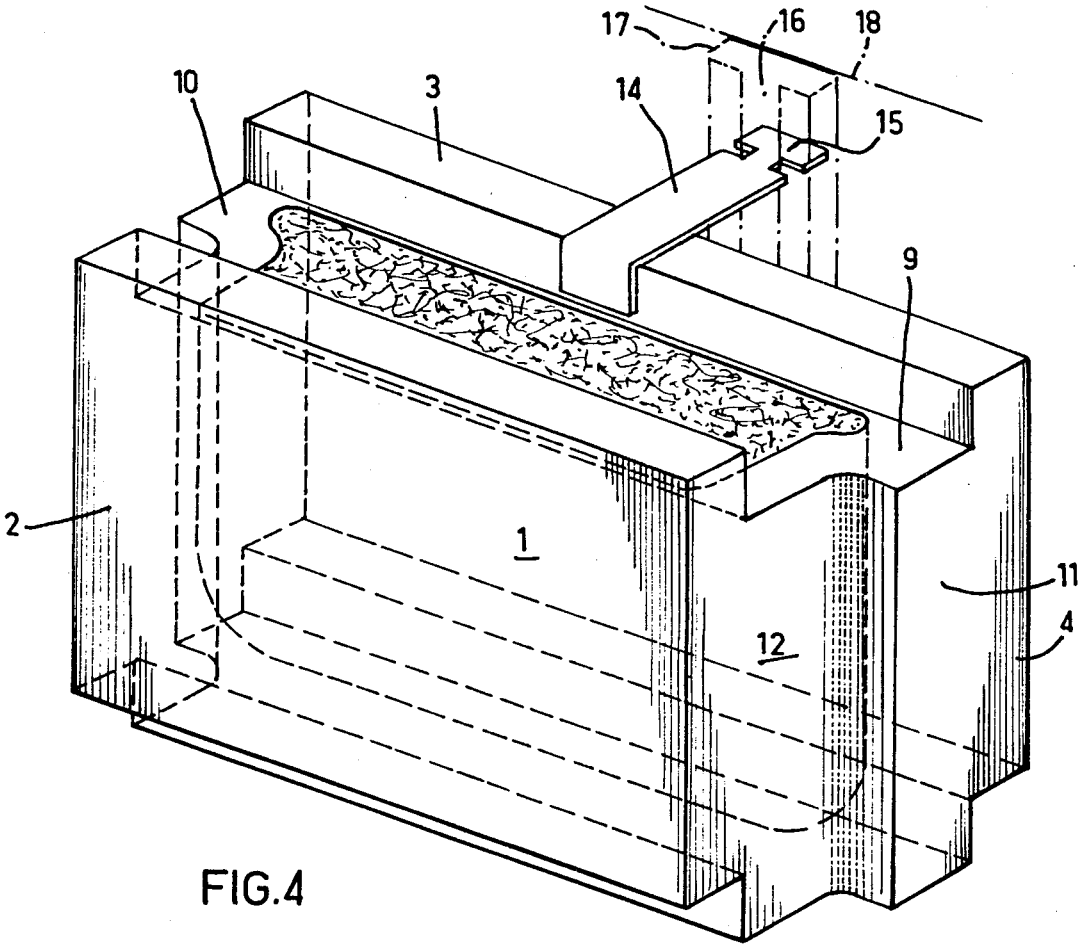
FIG. 4 is a perspective view of the element of FIG. 1.

In FIG. 4, there is shown at 14, a fastening iron. One of the features of a lining formed of elements according to the invention is that it has by itself a certain stability, so that it suffices for a small number of fastening irons suitably arranged to hold it both by the walls and by the ceilings. The iron 14 is of great simplicity since it is merely a flat iron element folded at 90 and becoming supported on the generally metallic inner surface of the furnace. At its other end, the iron 14 includes a part 15 of T-shape which can be introduced into the slot 16 of a slide 17 fast to the metal wall 18 of the furnace, by rotation of the iron 14. It is thus possible to position iron fastenings at any desired height.

The accompanying figures show a general definition of the principal geometry of the element according to the invention. It is possible, without departing from the scope of the latter, to provide lining elements having a different shape, notably as regards the profile of the small sides 4 and 5. In fact, according to the more or less severe conditions in which this type of lining is utilized, the design of the small sides can be completed by supplementary steps aimed at improving the fluid-tightness of the seal between elements and the mechanical stability of the whole of the lining.

Figure 5:
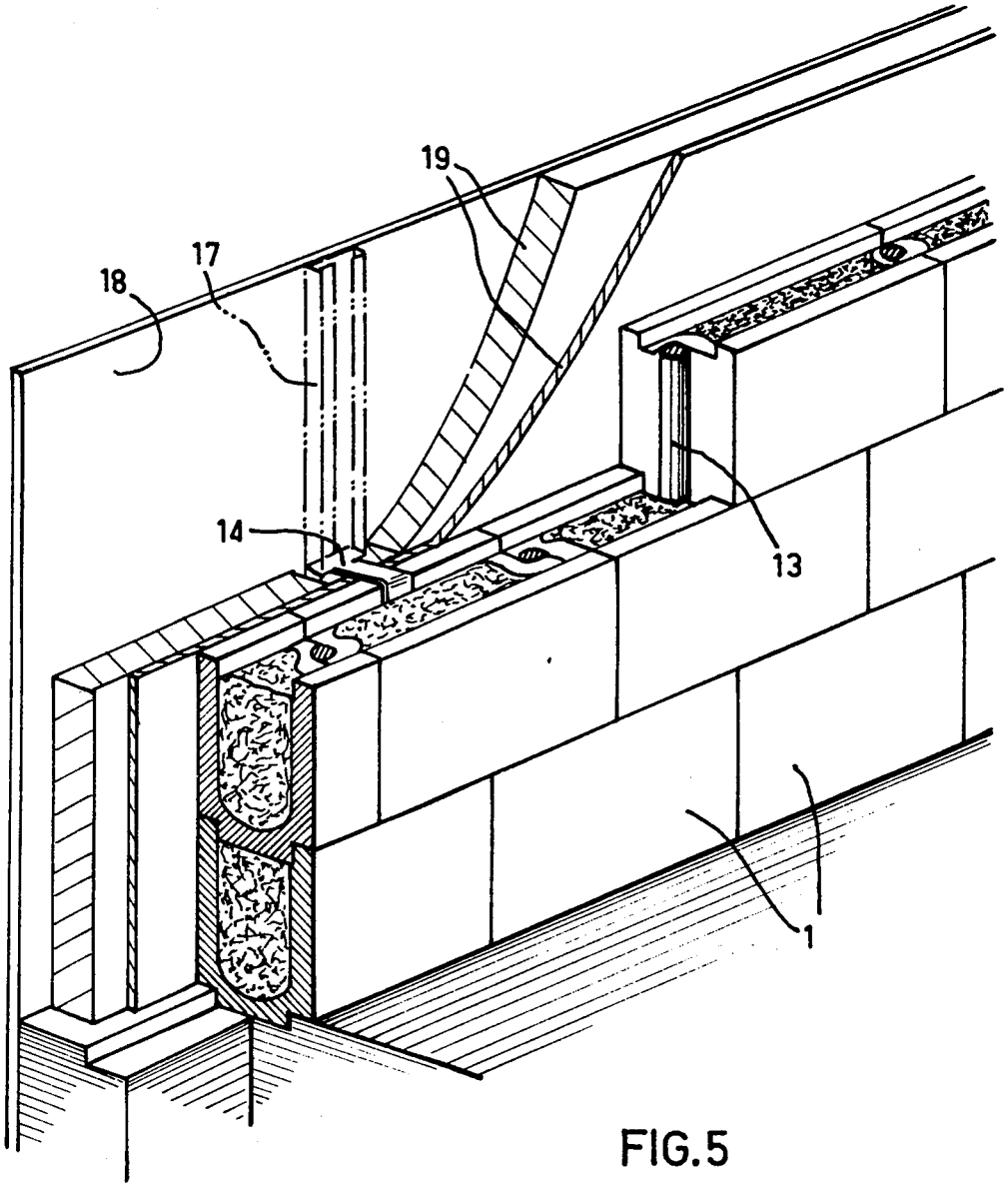
FIG. 5 is a perspective view of the lining of a wall.
Figure 6:
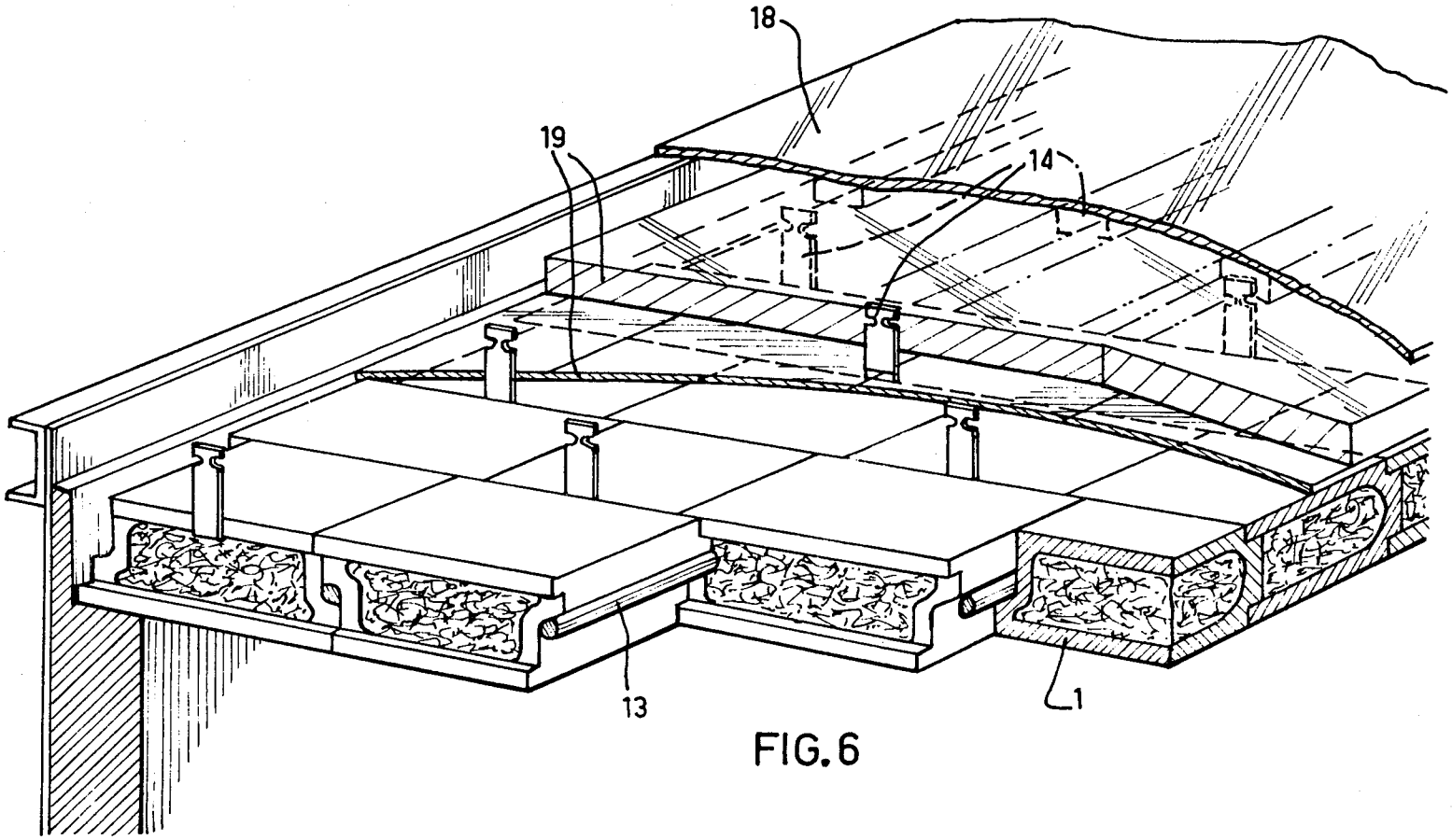
FIG. 6 is a perspective view of the lining of a ceiling.

FIGS. 5 and 6 show the positioning of the elements according to the invention for the lining construction of a wall or of a ceiling. The elements 1 being provided with their internal fiber lining, the construction is carried out with great simplicity, by setting in elements of the preceding row and by juxtaposition between neighboring elements of the same row taking care to position the beads 13 at each joint. It is also possible to provide the element with the bead fixed in advance.

Fastening irons 14 are then placed in position to hold the separation between the lining formed by the elements 1 and the metal wall 18, constant. Complementary insulation 19 can then be placed in the gap created between the lining and the metal wall.

We claim:

1. Refractory lining element for a furnace or the like, comprising two parallel principal walls of which one is arranged to be directed toward the inside of the furnace and the other toward the outside, and small side walls arranged to cooperate with neighboring similar elements to form the lining, the principal walls and two opposite small side walls being constituted of a rigid material formed of fibers bonded together, and a third small side being constituted of rigid material, thus providing an open-topped structure, filled with bulk fibers, said third small side being provided to constitute a bottom which resists the downward movement of the bulk fibers from a vertically positioned element towards those which are positioned below it, and said bottom having a projection designed to be set in the open top of the elements placed below it, in order to prevent any relative movement of these elements towards the inside or the outside of the furnace.

2. Lining element according to claim 1, wherein the small sides have a channeling of size corresponding to those of the projection of the bottom, which enables one element to be positioned with its bottom partially covering two other elements.

3. Lining element according to claim 1, in which the two opposite small sides constituted of rigid material are arranged to cooperate with the homologous sides of neighboring elements to resist relative movement of these elements towards the inside or the outside of the furnace, wherein the shape of said sides is calculated to imprison, between two neighboring elements, a sealing bead kept under compression.

4. Lining element according to claim 3, comprising at least on one small side, a sealing bead placed in advance in the position that it will occupy after assembly of the lining.

5. Lining element according to claim 3, wherein said small sides include additional steps designed to improve the fluid-tightness of the seal between elements and the mechanical stability of the whole of the lining.

* * * * *

UNITED STATES PATENT AND TRADEMARK OFFICE

CERTIFICATE OF CORRECTION

PATENT NO. : 4,206,577

DATED : June 10, 1980

INVENTOR(S) : Marcel Moriez and Jacques Delobel

It is certified that error appears in the above-identified patent and that said Letters Patent are hereby corrected as shown below:

On the title page, the assignee should correctly read

-- SOCIETE EUROPEENNE DES PRODUITS REFRACTAIRES --.

Signed and Sealed this

*Sixteenth* Day of *June 1981*

[SEAL]

*Attest:*

RENE D. TEGTMEYER

*Attesting Officer*

*Acting Commissioner of Patents and Trademarks*